US011353245B2

(12) United States Patent
Cole

(10) Patent No.: US 11,353,245 B2
(45) Date of Patent: Jun. 7, 2022

(54) COOLING SYSTEM WITH PARALLEL COMPRESSION USING MEDIUM TEMPERATURE COMPRESSORS

(71) Applicant: Heatcraft Refrigeration Products LLC, Stone Mountain, GA (US)

(72) Inventor: Douglas Cole, Columbus, GA (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 216 days.

(21) Appl. No.: 16/733,908

(22) Filed: Jan. 3, 2020

(65) Prior Publication Data

US 2021/0207851 A1 Jul. 8, 2021

(51) Int. Cl.

| | |
|---|---|
| ***F25B 1/10*** | (2006.01) |
| ***F25B 5/02*** | (2006.01) |
| ***F25B 41/20*** | (2021.01) |
| ***F25B 7/00*** | (2006.01) |
| ***F25B 49/02*** | (2006.01) |

(52) U.S. Cl.

CPC ..... *F25B 7/00* (2013.01); *F25B 1/10* (2013.01); *F25B 5/02* (2013.01); *F25B 41/20* (2021.01); *F25B 49/022* (2013.01); *F25B 2313/02331* (2013.01); *F25B 2400/0409* (2013.01); *F25B 2400/075* (2013.01); *F25B 2400/16* (2013.01); *F25B 2600/2501* (2013.01); *F25B 2600/2507* (2013.01)

(58) Field of Classification Search

CPC .... F25B 7/00; F25B 49/022; F25B 2400/054; F25B 2400/06; F25B 2400/061; F25B 2400/075; F25B 2313/02331; F25B 2400/0409; F25B 2600/2501; F25B 2600/2507

See application file for complete search history.

(56) References Cited

U.S. PATENT DOCUMENTS

| | | | | |
|---|---|---|---|---|
| 9,726,411 | B2 * | 8/2017 | Zimmermann | F25B 1/10 |
| 9,964,339 | B2 * | 5/2018 | Ali | F25B 40/00 |
| 9,964,348 | B2 * | 5/2018 | Ali | F25B 49/02 |
| 2014/0208785 | A1 * | 7/2014 | Wallace | F25B 49/02 62/115 |

(Continued)

FOREIGN PATENT DOCUMENTS

| | | | |
|---|---|---|---|
| EP | 3196568 | A1 | 7/2017 |
| EP | 3064866 | A1 | 9/2019 |
| EP | 3550222 | A1 | 10/2019 |

OTHER PUBLICATIONS

European Patent Office, Extended European Search Report, Application No. 20215223.7, dated May 27, 2021, 10 pages.

*Primary Examiner* — Jerry-Daryl Fletcher
*Assistant Examiner* — Daniel C Comings
(74) *Attorney, Agent, or Firm* — Baker Botts L.L.P.

(57) ABSTRACT

A cooling system is designed to operate in two different modes. Generally, in the first mode, when parallel compression is needed, certain valves are controlled to direct gaseous refrigerant from a tank to a compressor in the system and to direct refrigerant from low side heat exchangers towards other compressors. In this manner, a compressor in the system is transitioned to be generally a parallel compressor. In the second mode, when parallel compression is not needed, the valves are controlled to return the refrigerant flow back to normal.

17 Claims, 4 Drawing Sheets

(56) References Cited

U.S. PATENT DOCUMENTS

| | | | | |
|---|---|---|---|---|
| 2015/0345835 | A1* | 12/2015 | Martin | F25B 9/008<br>62/238.3 |
| 2017/0321941 | A1* | 11/2017 | Fredslund | F25B 41/40 |
| 2018/0156510 | A1 | 6/2018 | Zha | |
| 2019/0264933 | A1 | 8/2019 | Ignatiev et al. | |

* cited by examiner

COOLING SYSTEM WITH PARALLEL COMPRESSION USING MEDIUM TEMPERATURE COMPRESSORS

TECHNICAL FIELD

This disclosure relates generally to a cooling system.

BACKGROUND

Cooling systems may cycle a refrigerant (e.g., carbon dioxide refrigerant) to cool various spaces. Certain cooling systems include a tank, which may be referred to as a flash tank or a receiver, that holds or stores refrigerant. If the refrigerant in the tank absorbs heat, it may transition from a liquid to a gas. Conventional cooling systems are designed such that gaseous refrigerant in the tank is discharged to a parallel compressor.

SUMMARY

Cooling systems may cycle a refrigerant (e.g., carbon dioxide refrigerant) to cool various spaces. Certain cooling systems include a tank, which may be referred to as a flash tank or a receiver, that holds or stores refrigerant. If the refrigerant in the tank absorbs heat, it may transition from a liquid to a gas. Conventional cooling systems are designed such that gaseous refrigerant in the tank is discharged to one or more parallel compressors for compression. A high side heat exchanger (e.g., a gas cooler or condenser) then removes heat from the compressed refrigerant, and the refrigerant is returned to the tank.

The parallel compressors in conventional cooling systems, however, present several disadvantages. First, parallel compressors increase the financial cost of the cooling systems. Second, parallel compressors increase the overall size or footprint of the cooling system. Third, when the ambient temperature (e.g., the temperature of the outside air or the temperature of the air around the high side heat exchanger or tank) is too low (e.g., below 83 degrees Fahrenheit), the parallel compressor may not be used because it may be too cold for the refrigerant in the flash tank to transition to a gaseous state. Thus, in low ambient temperature conditions, the parallel compressor is wasted.

This disclosure contemplates an unconventional cooling system with parallel compressor(s) removed. The system is designed to operate in two different modes. Generally, in the first mode, when parallel compression is needed, certain valves are controlled to direct gaseous refrigerant from the tank to a compressor in the system and to direct refrigerant from low side heat exchangers towards other compressors. In this manner, a compressor in the system is transitioned to be generally a parallel compressor. In the second mode, when parallel compression is not needed, the valves are controlled to return the refrigerant flow back to normal. As a result, the unconventional cooling system provides parallel compression when parallel compression is needed thereby reducing the cost and size of the system over conventional systems. Additionally, the unconventional system does not add waste by letting a parallel compressor idle. Certain embodiments of the cooling system are described below.

According to an embodiment, a system includes a flash tank, a first low side heat exchanger, a second low side heat exchanger, a first compressor, a second compressor, a third compressor, a fourth compressor, a first valve, and a controller. The flash tank stores a refrigerant. The first low side heat exchanger uses refrigerant from the flash tank to cool a space proximate the first low side heat exchanger. The second low side heat exchanger uses refrigerant from the flash tank to cool a space proximate the second low side heat exchanger. The first compressor compresses refrigerant from the first low side heat exchanger. The second compressor compresses refrigerant from the first low side heat exchanger. The third compressor compresses refrigerant from the second low side heat exchanger and refrigerant from the first compressor. The first valve controls a flow of refrigerant from the flash tank to the fourth compressor. During a first mode of operation, the controller causes the first valve to open such that refrigerant from the flash tank flows, as a flash gas, through the first valve to the fourth compressor. During a second mode of operation, the controller causes the first valve to close such that refrigerant from the second low side heat exchanger flows to the fourth compressor.

According to another embodiment, a method includes storing, by a flash tank, a refrigerant, using, by a first low side heat exchanger, refrigerant from the flash tank to cool a space proximate the first low side heat exchanger, and using, by a second low side heat exchanger, refrigerant from the flash tank to cool a space proximate the second low side heat exchanger. The method also includes compressing, by a first compressor, refrigerant from the first low side heat exchanger, compressing, by a second compressor, refrigerant from the first low side heat exchanger, and compressing, by a third compressor, refrigerant from the second low side heat exchanger and refrigerant from the first compressor. The method further includes controlling, by a first valve, a flow of refrigerant from the flash tank to a fourth compressor, during a first mode of operation, causing, by a hardware processor, the first valve to open such that refrigerant from the flash tank flows, as a flash gas, through the first valve to the fourth compressor, and during a second mode of operation, causing, by the processor, the first valve to close such that refrigerant from the second low side heat exchanger flows to the fourth compressor.

According to yet another embodiment, a system includes a flash tank, a first low side heat exchanger, a second low side heat exchanger, a first compressor, a second compressor, a first valve, and a controller. The flash tank stores refrigerant from the high side heat exchanger. The first low side heat exchanger uses refrigerant from the flash tank to cool a space proximate the first low side heat exchanger. The second low side heat exchanger uses refrigerant from the flash tank to cool a space proximate the second low side heat exchanger. The first compressor compresses refrigerant from the first low side heat exchanger. The first valve controls a flow of refrigerant from the flash tank to the second compressor. During a first mode of operation, the controller causes the first valve to open such that refrigerant from the flash tank flows, as a flash gas, through the first valve to the second compressor. During a second mode of operation, the controller causes the first valve to close such that refrigerant from the second low side heat exchanger flows to the second compressor.

Certain embodiments provide one or more technical advantages. For example, an embodiment reduces the size and cost of a cooling system by removing a parallel compressor from the system. As another example, an embodiment reduces the waste caused by idling a parallel compressor by not including a parallel compressor in the system. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Embodiments of the present disclosure and its advantages are best understood by referring to FIGS. 1 through 4 of the drawings, like numerals being used for like and corresponding parts of the various drawings.

Cooling systems may cycle a refrigerant (e.g., carbon dioxide refrigerant) to cool various spaces. Certain cooling systems include a tank, which may be referred to as a flash tank or a receiver, that holds or stores refrigerant. If the refrigerant in the tank absorbs heat, it may transition from a liquid to a gas. Conventional cooling systems are designed such that gaseous refrigerant in the tank is discharged to one or more parallel compressors for compression. A high side heat exchanger (e.g., a gas cooler or condenser) then removes heat from the compressed refrigerant, and the refrigerant is returned to the tank.

The parallel compressors in conventional cooling systems, however, present several disadvantages. First, parallel compressors increase the financial cost of the cooling systems. Second, parallel compressors increase the overall size or footprint of the cooling system. Third, when the ambient temperature (e.g., the temperature of the outside air or the temperature of the air around the high side heat exchanger or tank) is too low (e.g., below 83 degrees Fahrenheit), the parallel compressor may not be used because it may be too cold for the refrigerant in the flash tank to transition to a gaseous state. Thus, in low ambient temperature conditions, the parallel compressor is wasted.

Figure 1:
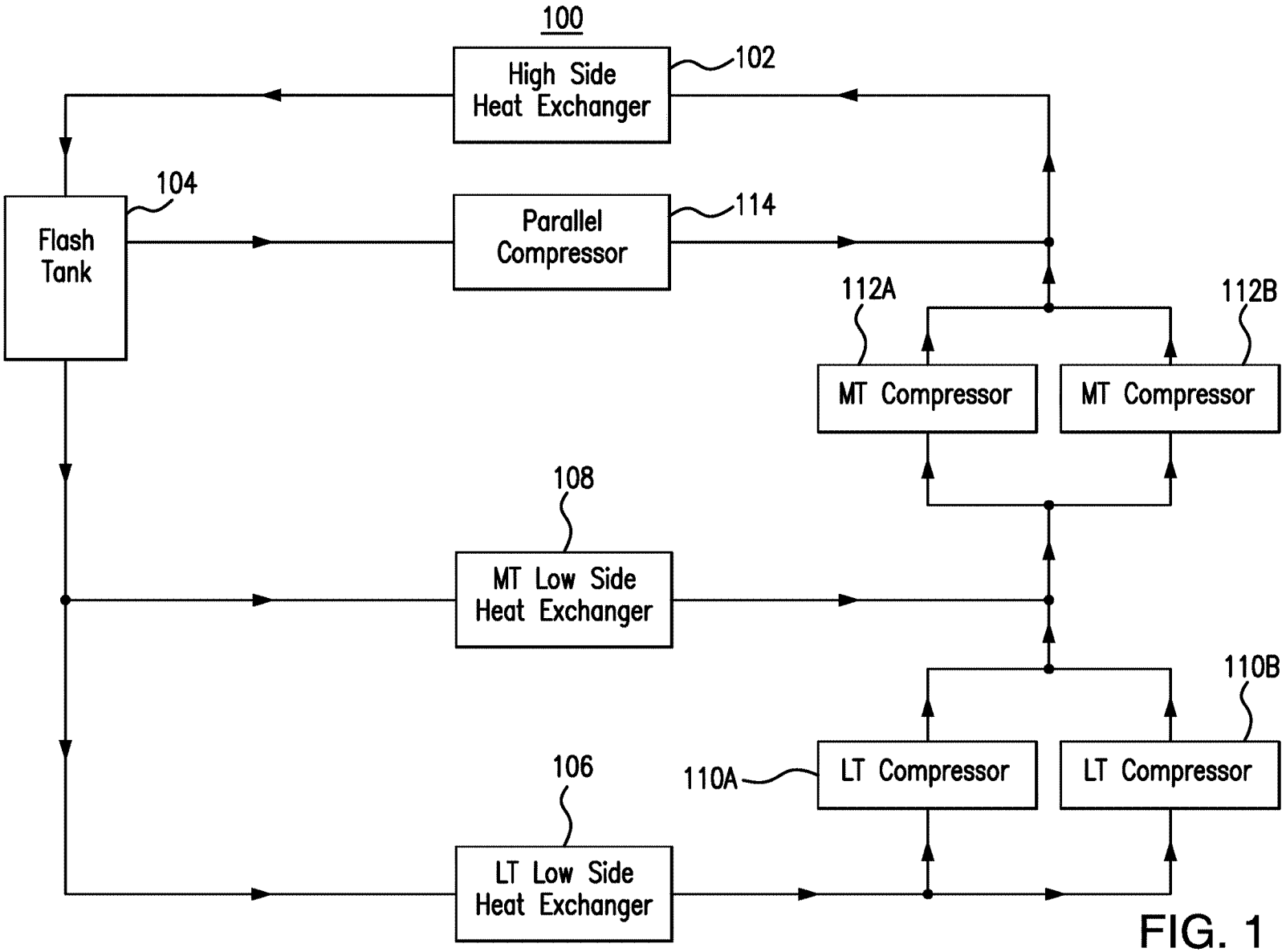
FIG. 1 illustrates an example cooling system.
Figure 2:
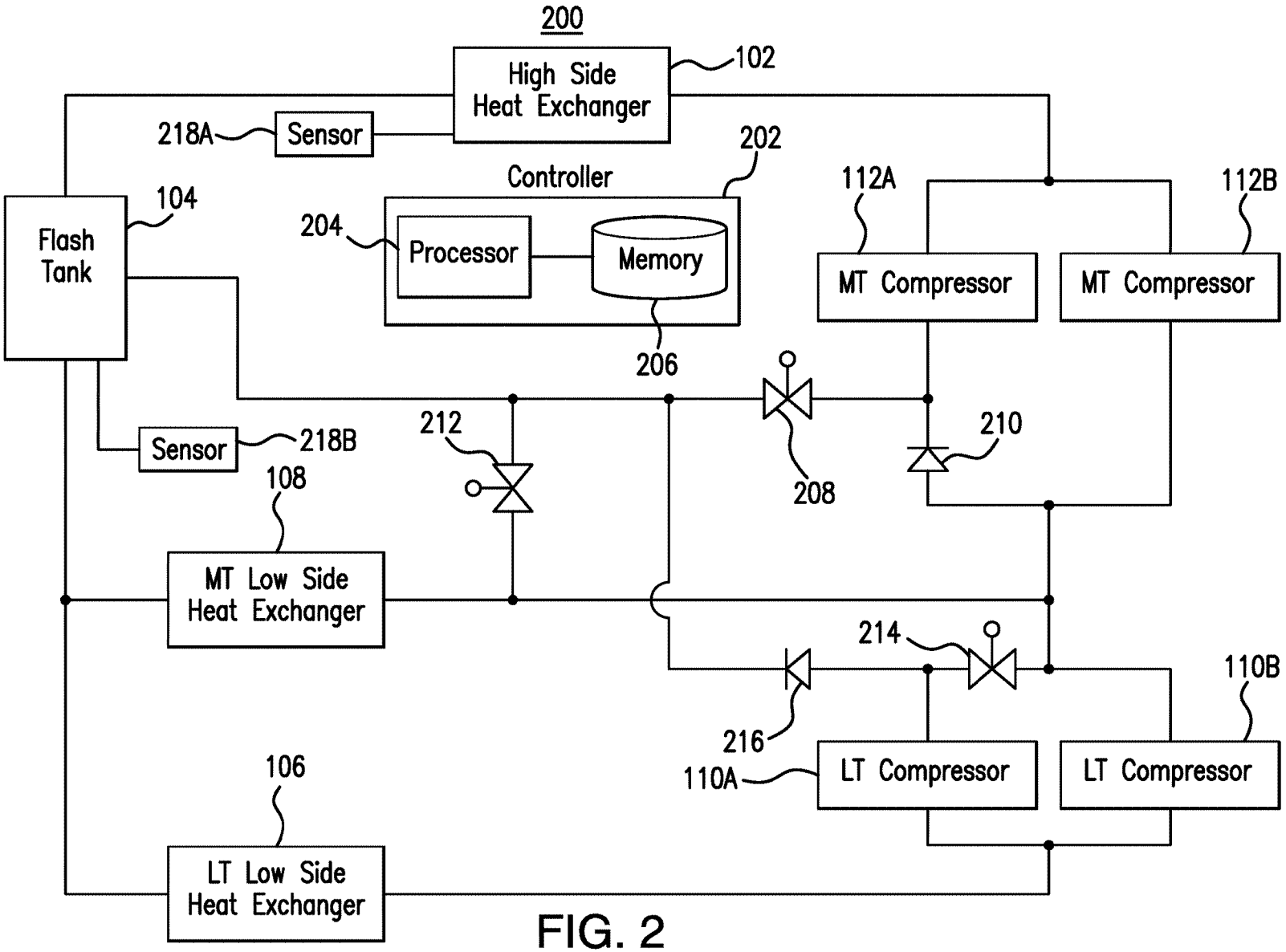
FIG. 2 illustrates an example cooling system.
Figure 3:
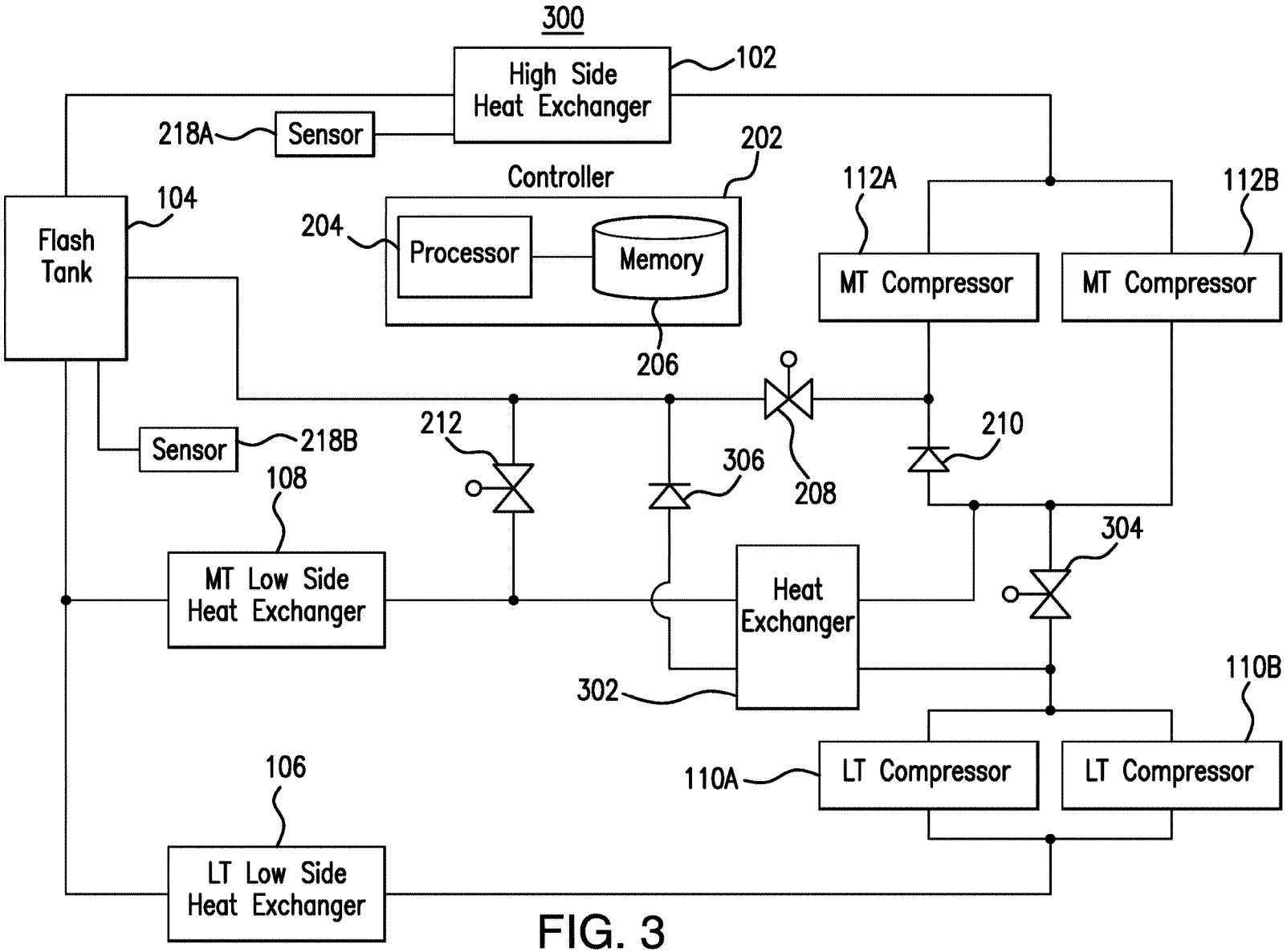
FIG. 3 illustrates an example cooling system.
Figure 4:
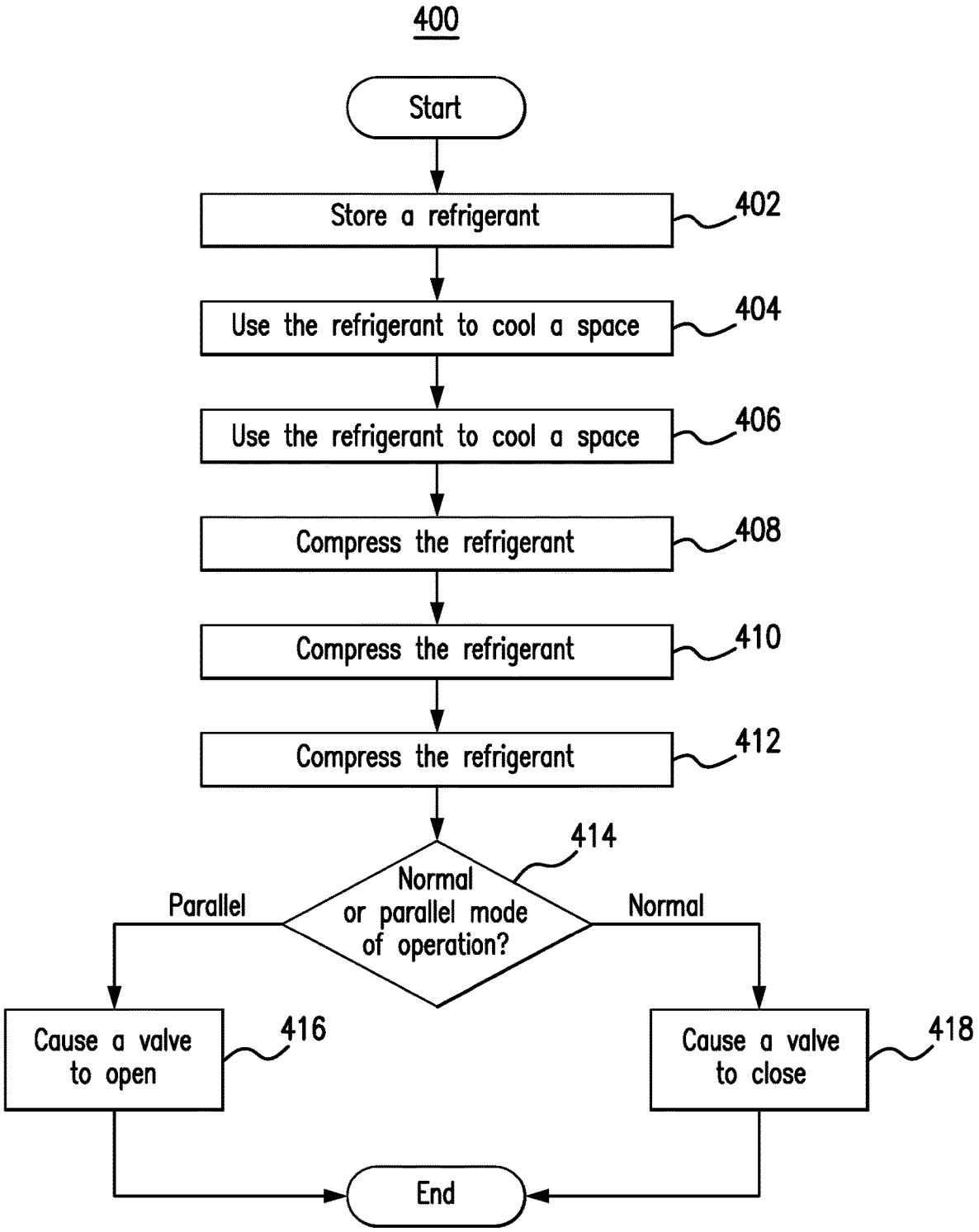
FIG. 4 is a flowchart illustrating a method of operating an example cooling system.

This disclosure contemplates an unconventional cooling system with parallel compressor(s) removed. The system is designed to operate in two different modes. Generally, in the first mode, when parallel compression is needed, certain valves are controlled to direct gaseous refrigerant from the tank to a compressor in the system and to direct refrigerant from low side heat exchangers towards other compressors. In this manner, a compressor in the system is transitioned to be generally a parallel compressor. In the second mode, when parallel compression is not needed, the valves are controlled to return the refrigerant flow back to normal. As a result, the unconventional cooling system provides parallel compression when parallel compression is needed thereby reducing the cost and size of the system over conventional systems. Additionally, the unconventional system does not add waste by letting a parallel compressor idle. The cooling system will be described using FIGS. 1 through 4. FIG. 1 will describe an existing cooling system with a parallel compressor. FIGS. 2 through 4 describe the cooling system without a parallel compressor.

FIG. 1 illustrates an example cooling system 100. As shown in FIG. 1, system 100 includes a high side heat exchanger 102, a flash tank 104, a low temperature low side heat exchanger 106, a medium temperature low side heat exchanger 108, low temperature compressors 110A and 110B, medium temperature compressors 112A and 112B, and a parallel compressor 114. Generally, system 100 cycles a refrigerant (e.g., carbon dioxide refrigerant) to cool spaces proximate low temperature low side heat exchanger 106 and medium temperature low side heat exchanger 108. Cooling system 100 or any cooling system described herein may include any number of high side heat exchangers 102, low flash tanks 104, low temperature low side heat exchangers 106, medium temperature low side heat exchangers 108, low temperature compressors 110, and medium temperature compressors 112.

High side heat exchanger 102 removes heat from a refrigerant. When heat is removed from the refrigerant, the refrigerant is cooled. This disclosure contemplates high side heat exchanger 102 being operated as a condenser and/or a gas cooler. When operating as a condenser, high side heat exchanger 102 cools the refrigerant such that the state of the refrigerant changes from a gas to a liquid. When operating as a gas cooler, high side heat exchanger 102 cools gaseous refrigerant and the refrigerant remains a gas. In certain configurations, high side heat exchanger 102 is positioned such that heat removed from the refrigerant may be discharged into the air. For example, high side heat exchanger 102 may be positioned on a rooftop so that heat removed from the refrigerant may be discharged into the air. As another example, high side heat exchanger 102 may be positioned external to a building and/or on the side of a building. This disclosure contemplates any suitable refrigerant (e.g., carbon dioxide) being used in any of the disclosed cooling systems.

Flash tank 104 stores refrigerant received from high side heat exchanger 102. This disclosure contemplates flash tank 104 storing refrigerant in any state such as, for example, a liquid state and/or a gaseous state. Refrigerant leaving flash tank 104 is fed to low temperature low side heat exchanger 106 and medium temperature low side heat exchanger 108. A flash gas and/or a gaseous refrigerant is released from flash tank 104 to parallel compressor 114. By releasing flash gas, the pressure within flash tank 104 may be reduced.

System 100 includes a low temperature portion and a medium temperature portion. The low temperature portion operates at a lower temperature than the medium temperature portion. In some refrigeration systems, the low temperature portion may be a freezer system and the medium temperature system may be a regular refrigeration system. In a grocery store setting, the low temperature portion may include freezers used to hold frozen foods, and the medium temperature portion may include refrigerated shelves used to hold produce. Refrigerant flows from flash tank 104 to both the low temperature and medium temperature portions of the refrigeration system. For example, the refrigerant flows to low temperature low side heat exchanger 106 and medium temperature low side heat exchanger 108. When the refrigerant reaches low temperature low side heat exchanger 106 or medium temperature low side heat exchanger 108, the refrigerant removes heat from the air around low temperature low side heat exchanger 106 or medium temperature low side heat exchanger 108. As a result, the air is cooled. The cooled air may then be circulated such as, for example, by a fan to cool a space such as, for example, a freezer and/or a refrigerated shelf. As refrigerant passes through low temperature low side heat exchanger 106 and medium temperature low side heat exchanger 108, the refrigerant may change from a liquid state to a gaseous state as it absorbs heat. This disclosure contemplates including any number of low temperature low side heat exchangers 106 and medium temperature low side heat exchangers 108 in any of the disclosed cooling systems.

The refrigerant cools metallic components of low temperature low side heat exchanger 106 and medium temperature low side heat exchanger 108 as the refrigerant passes through low temperature low side heat exchanger 106 and medium temperature low side heat exchanger 108. For example, metallic coils, plates, parts of low temperature low side heat exchanger 106 and medium temperature low side heat exchanger 108 may cool as the refrigerant passes through them.

Refrigerant flows from low temperature low side heat exchanger 106 and medium temperature low side heat exchanger 108 to compressors 110 and 112. This disclosure contemplates the disclosed cooling systems including any number of low temperature compressors 110 and medium temperature compressors 112. Both the low temperature compressors 110 and medium temperature compressors 112 compress refrigerant to increase the pressure of the refrigerant. As a result, the heat in the refrigerant may become concentrated and the refrigerant may become a high-pressure gas. Low temperature compressors 110A and 110B compress refrigerant from low temperature low side heat exchanger 106 and sends the compressed refrigerant to medium temperature compressors 112A and 112B. Medium temperature compressors 112A and 112B compress a mixture of the refrigerant from low temperature compressors 110A and 110B and medium temperature low side heat exchanger 108. Medium temperature compressors 112A and 112B then send the compressed refrigerant to high side heat exchanger 102.

Parallel compressor 114 compresses flash gas that is released from flash tank 104. As discussed previously, flash tank 104 releases refrigerant in the form of flash gas to regulate an internal pressure of flash tank 104. Parallel compressor 114 compresses the flash gas to concentrate the heat in the flash gas. Parallel compressor 114 then directs the compressed flash gas to high side heat exchanger 102. Parallel compressor 114, however, presents several disadvantages. First, parallel compressor 114 increase the financial cost of the cooling system 100. Second, parallel compressor 114 increases the overall size or footprint of the cooling system 100. Third, when the ambient temperature (e.g., the temperature of the outside air or the temperature of the air around the high side heat exchanger 102 or flash tank 104) is too low (e.g., below 83 degrees Fahrenheit), parallel compressor 114 may not be used because it may be too cold for the refrigerant in the flash tank 104 to transition to a gaseous state. Thus, in low ambient temperature conditions, parallel compressor 114 is wasted.

This disclosure contemplates an unconventional cooling system with parallel compressor 114 removed. The system is designed to operate in two different modes. Generally, in the first mode, when parallel compression is needed, certain valves are controlled to direct gaseous refrigerant from the flash tank 104 to a compressor in the system and to direct refrigerant from low side heat exchangers towards other compressors. In this manner, a compressor in the system is transitioned to be generally a parallel compressor. In the second mode, when parallel compression is not needed, the valves are controlled to return the refrigerant flow back to normal. As a result, the unconventional cooling system provides parallel compression when parallel compression is needed thereby reducing the cost and size of the system over conventional systems. Additionally, the unconventional system does not add waste by letting a parallel compressor idle. The cooling system will be described using FIGS. 2 through 4. These figures illustrate embodiments that include a certain number of low side heat exchangers and compressors for clarity and readability. However, these embodiments may include any suitable number of low side heat exchangers and compressors.

FIG. 2 illustrates an example cooling system 200. As seen in FIG. 2, system 200 includes a high side heat exchanger 102, a flash tank 104, a low temperature low side heat exchanger 106, a medium temperature low side heat exchanger 108, low temperature compressors 110A and 110B, medium temperature compressors 112A and 112B, a controller 202, and valves 208, 210, 212, 214, and 216, and sensors 218A and 218B. Generally, system 200 operates in two modes of operation. When parallel compression is needed, system 200 adjusts valves 208, 212, and 214 to provide parallel compression using medium temperature compressor 112A. When parallel compression is not needed, system 200 adjusts valves 208, 212, and 214 to direct regular refrigerant flow to medium temperature compressor 112A. In this manner, system 200 provides parallel compression without a parallel compressor separate from low temperature compressors 110 and medium temperature compressors 112. For clarity, system 200 is illustrated with two low temperature compressors 110, two medium temperature compressors 112, and one valve 208. System 200, however, may include any suitable number of low temperature compressors 110, medium temperature compressors 112, and valves 208 that control the flow of flash gas to one or more of the medium temperature compressors 112.

High side heat exchanger 102, flash tank 104, low temperature low side heat exchanger 106, medium temperature low side heat exchanger 108, low temperature compressors 110A and 110B, and medium temperature compressor 112B operate similarly in system 200 as they did in system 100. For example, high side heat exchanger 102 removes heat from a refrigerant. Flash tank 104 stores the refrigerant. Low temperature low side heat exchanger 106 and medium temperature low side heat exchanger 108 use refrigerant from flash tank 104 to cool spaces proximate low temperature low side heat exchanger 106 and medium temperature low side heat exchanger 108. Low temperature compressors 110A and 110B compress refrigerant from low temperature low side heat exchanger 106. Medium temperature compressor 112B compresses refrigerant from medium temperature low side heat exchanger 108 and one or more of low temperature compressors 110A and 110B.

Controller 202 includes a processor 204 and a memory 206. Processor 204 and memory 206 may be configured to perform any of the functions of controller 202 described herein. Generally, controller 202 uses measurements from one or more sensors 218 to determine whether system 200 should transition between two modes of operation: a regular mode of operation and a parallel mode of operation, in which parallel compression is provided. Controller 202 then adjusts one or more of valves 208, 212, and 214 to transition system 200 between these different modes of operation, for example, to provide parallel compression.

Processor 204 is any electronic circuitry, including, but not limited to microprocessors, application specific integrated circuits (ASIC), application specific instruction set processor (ASIP), and/or state machines, that communicatively couples to memory 206 and controls the operation of controller 202 and/or system 200. Processor 204 may be 8-bit, 16-bit, 32-bit, 64-bit or of any other suitable architecture. Processor 204 may include an arithmetic logic unit (ALU) for performing arithmetic and logic operations, processor registers that supply operands to the ALU and store the results of ALU operations, and a control unit that fetches instructions from memory and executes them by directing the coordinated operations of the ALU, registers and other components. Processor 204 may include other hardware that operates software to control and process information. Processor 204 executes software stored on memory to perform any of the functions described herein. Processor 204 controls the operation and administration of controller 202 and/or system 200 by processing information received from components of system 200 (e.g., sensors 218 and memory 206). Processor 204 may be a programmable logic device, a microcontroller, a microprocessor, any suitable processing device, or any suitable combination of the preceding. Processor 204 is not limited to a single processing device and may encompass multiple processing devices.

Memory 206 may store, either permanently or temporarily, data, operational software, or other information for processor 204. Memory 206 may include any one or a combination of volatile or non-volatile local or remote devices suitable for storing information. For example, memory 206 may include random access memory (RAM), read only memory (ROM), magnetic storage devices, optical storage devices, or any other suitable information storage device or a combination of these devices. The software represents any suitable set of instructions, logic, or code embodied in a computer-readable storage medium. For example, the software may be embodied in memory 206, a disk, a CD, or a flash drive. In particular embodiments, the software may include an application executable by processor 204 to perform one or more of the functions described herein.

Valve 208 controls a flow of refrigerant (e.g., flash gas) from flash tank 104 to medium temperature compressor 112A. When valve 208 is open, refrigerant from flash tank 104 flows through valve 208 to medium temperature compressor 112A. When valve 208 is closed, valve 208 prevents refrigerant from flash tank 104 from flowing through valve 208 to medium temperature compressor 112A. During a regular mode of operation, valve 208 is closed. During a parallel mode of operation, when parallel compression is provided, valve 208 is open.

Valve 210 controls a flow of refrigerant to medium temperature compressor 112A. Valve 210 opens and closes based on pressure differences. Valve 210 also prevents refrigerant from backflowing through valve 210. In other words, valve 210 prevents refrigerant from flowing from medium temperature compressor 112A through valve 210. Generally, during a normal mode of operation, valve 210 is open to allow refrigerant to flow to medium temperature compressor 112A through valve 210. During a parallel mode of operation, when parallel compression is provided, valve 210 closes due to a pressure change caused by the opening of valve 208.

Valve 212 controls a flow of refrigerant (e.g. flash gas) from flash tank 104. When valve 212 is open, refrigerant from flash tank 104 flows to medium temperature compressors 112A and 112B through valve 212. When valve 212 is closed, valve 212 prevents refrigerant from flash tank 104 from flowing through valve 212. Generally, during a normal mode of operation, valve 212 is open. During a parallel mode of operation, when parallel compression is provided, valve 212 is closed.

Valve 214 controls a flow of refrigerant from low temperature compressor 110A. When valve 214 is open, refrigerant from low temperature compressor 110A flows through valve 214 to one or more of medium temperate compressors 112A and 112B. When valve 214 is closed, valve 214 prevents refrigerant from low temperature compressor 110A from flowing through valve 214. Generally, during a normal mode of operation, valve 214 is open. During a parallel mode of operation, valve 214 may be opened or closed, depending on the pressure at medium temperature compressor 112A.

Valve 216 controls a flow of refrigerant from low temperature compressor 110A. Valve 216 also prevents refrigerant from backflowing towards low temperature compressor 110A. Valve 216 opens and closes based on pressure differences in system 200 (e.g., pressure differences caused by the opening and closing of valve 214). Generally, during a normal mode of operation, valve 216 is closed. During a parallel mode of operation, when valve 214 is closed, valve 216 opens to allow refrigerant from low temperature compressor 110A to flow through valve 216.

Sensors 218A and 218B detect and/or measure certain characteristics in, near, or around high side heat exchanger 102 and/or flash tank 104. For example, sensor 218A may be a temperature sensor that detects an ambient (e.g., outdoor) temperature or a temperature around high side heat exchanger 102. As another example, sensor 218B may be a pressure sensor that detects an internal pressure of flash tank 104. Sensors 218A and 218B are not limited to the provided examples. Sensors 218A and 218B may be any suitable sensors that detect refrigerant temperature and/or pressure at any location in system 200. Sensors 218 may communicate measurements to controller 202 so that controller 202 may make determinations for system 200.

Generally, system 200 operates in two modes of operation; a regular mode of operation and a parallel mode of operation. Controller 202 transitions system 200 from the normal mode of operation to the parallel mode of operation when certain measurements from sensor 218A and/or sensor 218B (and possibly other measurements or characteristics of system 200) indicate that parallel compression may be helpful. Controller 202 transitions system 200 from the parallel mode of operation to the normal mode of operation when certain measurements from sensor 218A and/or sensor 218B (and possibly other measurements or characteristics of system 200) indicate that parallel compression should be removed and/or turned off. Controller 202 adjusts one or more of valves 208, 212, and 214 to transition system 200 between these modes of operation.

During the regular mode of operation, parallel compression is not provided. Controller 202 closes valve 208, opens valve 212, and opens valve 214 (to the extent valve 214 is not already open). High side heat exchanger 102 removes heat from a refrigerant. Flash tank 104 stores the refrigerant. Low temperature low side heat exchanger 106 and medium temperature low side heat exchanger 108 use refrigerant from flash tank 104 to cool spaces proximate low temperature low side heat exchanger 106 and medium temperature low side heat exchanger 108. Low temperature compressors 110A and 110B compress refrigerant from low temperature low side heat exchanger 106. Refrigerant from low temperature compressors 110A and 110B flow to medium temperature compressors 112A and 112B. Additionally, refrigerant from medium temperature low side heat exchanger 108 flows to medium temperature compressors 112A and 112B. Furthermore, flash gas from flash tank 104 flows to medium temperature compressors 112A and 112B through valve 212. Medium temperature compressors 112A and 112B compress refrigerant from low temperature compressors 110A and 110B, medium temperature low side heat exchanger 108, and flash tank 104.

Controller 202 may transition system 200 from the normal mode of operation to the parallel mode of operation based on one or more conditions in system 200. For example, controller 202 may determine that system 200 should transition from the normal mode of operation to the parallel mode of operation when a detected ambient temperature (e.g., a temperature detected by sensor 218A) exceeds a threshold (e.g., 83 degrees Fahrenheit). When the ambient temperature exceeds the threshold, the refrigerant in flash tank 104 may convert to a gaseous state, thus increasing the need for parallel compression. In certain embodiments, controller 202 also considers other factors in determining whether to transition system 200 from the normal mode of operation to the parallel mode of operation. For example, controller 202 may consider whether a high pressure safety alarm has been triggered at medium temperature compressors 112A and 112B. If the alarm has not been triggered, then it is safe for controller 202 to transition system 200 from the normal mode of operation to the parallel mode of operation. As another example, controller 202 may consider if a valve that directs flash gas out of flash tank 104 is open beyond a threshold. The more that this valve is open, the more flash gas is contained and/or leaving flash tank 104. Thus, if the valve is opened too much, then controller 202 may determine that there is too much flash gas in system 200 and that system 200 should transition from the normal mode of operation to the parallel mode of operation. As another example, controller 202 may consider how much refrigerant is being compressed by medium temperature compressors 112A and 112B. If medium temperature compressors 112A and 112B are compressing too much refrigerant, then controller 202 may transition system 200 from the normal mode of operation to the parallel mode of operation to use medium temperature compressor 112A as a parallel compressor. Controller 202 may consider one or more of any of these example factors in addition to the detected ambient temperature in determining whether to transition system 200 from the normal mode of operation to the parallel mode of operation.

Controller 202 transitions system 200 from the normal mode of operation to the parallel mode of operation by adjusting certain valves in system 200. Specifically, controller 202 opens valve 208 and closes valve 212 to transition system 200 from the normal mode of operation to the parallel mode of operation. When valve 208 is opened and valve 212 is closed, valve 210 closes to prevent refrigerant from flowing to medium temperature compressor 112A through valve 210. As a result of opening valve 208 and closing valve 212, flash gas from flash tank 104 flows to medium temperature compressor 112A through valve 208. Valves 210 and 216 are closed to prevent the flash gas from backflowing through valves 210 and 216. As a result, medium temperature compressor 112A acts as a parallel compressor that compresses the flash gas from flash tank 104. Meanwhile, medium temperature compressor 112B compresses refrigerant from low temperature compressors 110A and 110B and medium temperature low side heat exchanger 108.

In certain embodiments, during the parallel mode of operation, an internal pressure of flash tank 104 may drop below a threshold. In these situations, refrigerant from low temperature compressor 110A may be supplied to medium temperature compressor 112A to counteract the drop in flash gas pressure from flash tank 104. Sensor 218B may detect an internal pressure of flash tank 104. Controller 202 may compare the pressure detected by sensor 218B to a threshold to determine that the internal pressure of flash tank 104 is too low. In response, controller 202 closes valve 214 such that valve 214 prevents refrigerant from low temperature compressor 110A from flowing through valve 214. As a result of closing valve 214, valve 216 opens. Refrigerant from low temperature compressor 110A then flows through valve 216 and valve 208 to medium temperature compressor 112A. As a result, the pressure of the refrigerant received by medium temperature compressor 112A increases. When the pressure detected by sensor 218B exceeds the threshold, controller 202 may open valve 214 to again allow refrigerant from low temperature compressor 110A to flow through valve 214 to medium temperature compressor 112B. Controller 202 may consider other factors in determining whether to open and/or close valve 214, such as for example, whether a low superheat alarm or compressor safety alarm is triggered. In some embodiments, controller 202 may close valve 214 as part of the transition from the parallel mode of operation to the normal mode of operation (e.g., if an internal pressure of flash tank 104 drops below a threshold for transitioning to the normal mode of operation).

Controller 202 may determine that system 200 should transition from the parallel mode of operation back to the normal mode of operation based on one or more factors. For example, controller 202 may transition system 200 from the parallel mode of operation to the normal mode of operation when an internal pressure of flash tank 104 is too low and refrigerant supplied by low temperature compressor 110A through valve 216 does not raise the pressure of the refrigerant at medium temperature compressor 112A to a sufficient pressure level. In certain embodiments, controller 202 also considers one or more other factors such as a safety alarm at one or more medium temperature compressors 112A and 112B being triggered.

Controller 202 transitions system 200 from the parallel mode of operation to normal mode of operation by closing valve 208 and opening valve 212. When valve 208 is closed, valve 210 opens to allow refrigerant to flow to medium temperature compressor 112A through valve 210. Flash gas from flash tank 104 flows through valve 212 to medium temperature compressors 112A and 112B. In certain embodiments, controller 202 also opens valve 214 to allow refrigerant from low temperature compressor 110A to flow to medium temperature compressors 112A and 112B. When valve 214 is opened, valve 216 closes.

In this manner, controller 202 allows system 200 to operate in a normal mode of operation and a parallel mode of operation to provide parallel compression. As a result, system 200 does not need to include an additional parallel compressor which reduces the footprint and energy usage of system 200 relative to conventional systems. Additionally, system 200 does not waste a parallel compressor by letting the parallel compressor idle when parallel compression is not needed.

FIG. 3 illustrates an example cooling system 300. As seen in FIG. 3, system 300 includes high side heat exchanger 102, flash tank 104, low temperature low side heat exchanger 106, medium temperature low side heat exchanger 108, low temperature compressors 110A and 110B, medium temperature compressors 112A and 112B, controller 202, valve 210, valve 212, sensors 218A and 218B, heat exchanger 302, valve 304, and valve 306. Generally, system 300 operates similarly as system 200 except system 300 can divert refrigerant from both low temperature compressor 110A and low temperature compressor 110B to medium temperature compressor 112A during the parallel mode of operation. Heat from the refrigerant from low temperature compressors 110A and 110B is transferred to the refrigerant from medium temperature low side heat exchanger 108 through heat exchanger 302.

High side heat exchanger 102, flash tank 104, low temperature low side heat exchanger 106, medium temperature low side heat exchanger 108, low temperature compressor 110A and 110B, medium temperature compressors 112A and 112B, controller 202, valve 208, valve 210, valve 212, and sensors 218A and 218B operate similarly in system 300 as they did in system 200. For example, high side heat exchanger 102 removes heat from a refrigerant. Flash tank 104 stores the refrigerant. Low temperature low side heat exchanger 106 and medium temperature low side heat exchanger 108 use refrigerant from flash tank 104 to cool spaces proximate low temperature low side heat exchanger 106 and medium temperature low side heat exchanger 108. Low temperature compressors 110A and 110B compress refrigerant from low temperature low side heat exchanger 106. Medium temperature compressors 112A and 112B compress refrigerant from low temperature compressors 110A and 110B, medium temperature low side heat exchanger 108, and flash tank 104 during a normal mode of operation. During a parallel mode of operation, medium temperature compressor 112A compresses refrigerant in the form of flash gas from flash tank 104, and medium temperature compressor 112B compresses refrigerant from low temperature compressors 110A and 110B and medium temperature low side heat exchanger 108. Controller 202 uses measurements from sensors 218A and 218B to determine whether to transition system 300 between the normal mode of operation and the parallel mode of operation. Valve 208 is closed during the normal mode of operation and open during the parallel mode of operation. Valve 210 prevents refrigerant from back flowing through valve 210. Valve 210 is open during the normal mode of operation and closed during the parallel mode of operation. Valve 212 controls the flow of refrigerant from flash tank 104. During the normal mode of operation, valve 212 is open. During the parallel mode of operation, valve 212 is closed.

Heat exchanger 302 may transfer heat from the refrigerant from low temperature compressors 110A and 110B to the refrigerant from medium temperature low side heat exchanger 108 during the parallel mode of operation. Specifically, during the parallel mode of operation, controller 202 may determine that valve 304 should be closed to direct the refrigerant from low temperature compressors 110A and 110B to medium temperature compressor 112A to supplement the pressure from the flash gas from flash tank 104. When valve 304 is closed, the refrigerant from low temperature compressors 110A and 110B is directed towards heat exchanger 302. Additionally, valve 306 may open when valve 304 is closed to allow refrigerant from heat exchanger 302 to flow towards medium temperature compressor 112A. Heat exchanger 302 transfers heat from the refrigerant from low temperature compressors 110A and 110B to the refrigerant from medium temperature low side heat exchanger 108. As a result, the refrigerant from medium temperature low side heat exchanger 108 is heated and the refrigerant from low temperature compressors 110A and 110B is cooled. The refrigerant from low temperature compressors 110A and 110B then flows through valve 306 and valve 208 to medium temperature compressor 112A. In this manner, refrigerant from low temperature compressors 110A and 110B can supplement flash gas from flash tank 104 when the pressure of the flash gas from flash tank 104 is insufficient. As a corollary, when refrigerant from low temperature compressors 110A and 110B is diverted to medium temperature compressor 112A during the parallel mode of operation, medium temperature compressor 112B compresses refrigerant from medium temperature low side heat exchanger 108 but not refrigerant from flash tank 104 and low temperature compressors 110A and 110B. Generally, controller 202 opens and closes valve 304 based on the same considerations for opening and closing valve 214 in system 200.

FIG. 4 is a flow chart illustrating a method 400 of operating an example cooling system 200 and/or 300. Generally, various components of systems 200 and/or 300 perform the steps of method 400. In particular embodiments, method 400 allows systems 200 and/or 300 to transition between a normal mode of operation and a parallel mode of operation to provide parallel compression.

In step 402, flash tank 104 stores a refrigerant. Low temperature low side heat exchanger 106 uses the refrigerant from flash tank 104 to cool a space in step 404. In step 406, medium temperature low side heat exchanger 108 uses the refrigerant from flash tank 104 to cool a space. Low temperature compressor 110A compresses the refrigerant from low temperature low side heat exchanger 106 in step 408. In step 410, low temperature compressor 110B compresses refrigerant from low temperature low side heat exchanger 106. In step 412, medium temperature compressor 112B compresses the refrigerant from medium temperature low side heat exchanger 108 and one or more of low temperature compressors 110A and 110B.

Controller 202 determines whether system 200 and/or 300 should operate in a normal or parallel mode of operation in step 414. Controller 202 may make this determination based on one or more factors such as, for example, a detected ambient temperature and/or an internal pressure of flash tank 104. If controller 202 determines that system 200 and/or 300 should be operating in the parallel mode of operation, controller 202 causes a valve 208 to open in step 416. Additionally, controller 202 may close a valve 212. In this manner, flash gas from flash tank 104 is directed to medium temperature compressor 112A and not to other compressors in systems 200 and/or 300. Refrigerant from low temperature compressors 110 and refrigerant from medium temperature low side heat exchanger 108 is directed to medium temperature compressor 112B.

If controller 202 determines that systems 200 and/or 300 should operate in a normal mode of operation, controller 202 may cause valve 208 to close in step 418. Additionally, controller 202 may open valve 212. In this manner, medium temperature compressors 112A and 112B compress refrigerant from low temperature compressor 110A and 110B, medium temperature low side heat exchanger 108, and flash tank 104.

Modifications, additions, or omissions may be made to method 300 depicted in FIG. 3. Method 300 may include more, fewer, or other steps. For example, steps may be performed in parallel or in any suitable order. While discussed as systems 200 and/or 300 (or components thereof) performing the steps, any suitable component of systems 200 and/or 300 may perform one or more steps of the method.

Modifications, additions, or omissions may be made to the systems and apparatuses described herein without departing from the scope of the disclosure. The components of the systems and apparatuses may be integrated or separated. Moreover, the operations of the systems and apparatuses may be performed by more, fewer, or other components. Additionally, operations of the systems and apparatuses may be performed using any suitable logic comprising software, hardware, and/or other logic. As used in this document, "each" refers to each member of a set or each member of a subset of a set.

This disclosure may refer to a refrigerant being from a particular component of a system (e.g., the refrigerant from the medium temperature compressor, the refrigerant from the low temperature compressor, the refrigerant from the flash tank, etc.). When such terminology is used, this disclosure is not limiting the described refrigerant to being directly from the particular component. This disclosure contemplates refrigerant being from a particular component (e.g., the high side heat exchanger) even though there may be other intervening components between the particular component and the destination of the refrigerant. For example, the flash tank receives a refrigerant from the high side heat exchanger even though there may be valves between the flash tank and the high side heat exchanger.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. A system comprising:

a flash tank configured to store a refrigerant;

a first low side heat exchanger configured to use the refrigerant from the flash tank to cool a space proximate the first low side heat exchanger;

a second low side heat exchanger configured to use the refrigerant from the flash tank to cool a space proximate the second low side heat exchanger;

a first compressor configured to compress a flow of refrigerant from the first low side heat exchanger;

a second compressor configured to compress a flow of refrigerant from the first low side heat exchanger;

a third compressor configured to compress a flow of refrigerant from the second low side heat exchanger and a flow of refrigerant from the first compressor;

a fourth compressor;

a first valve configured to control a flow of refrigerant from the flash tank to the fourth compressor;

a second valve configured to control a flow of refrigerant from the second compressor;

a third valve disposed between the first valve and the second valve, configured to prevent a flow of refrigerant from the flash tank from flowing to the second compressor; and a controller comprising a memory and a hardware processor, the processor configured to:

during a first mode of operation, cause the first valve to open such that the refrigerant from the flash tank flows, as a flash gas, through the first valve to the fourth compressor; and cause the second valve to close such that the flow of refrigerant from the second compressor flows to the fourth compressor through the third valve; and during a second mode of operation, cause the first valve to close such that a flow of refrigerant from the second low side heat exchanger flows to the fourth compressor.

2. The system of claim 1, the processor is further configured to:

transition from the first mode of operation to the second mode of operation at least in response to a determination that a detected temperature exceeds a threshold; and transition from the second mode of operation to the first mode of operation at least in response to a determination that a detected pressure of the flash tank is below the threshold.

3. The system of claim 1, the processor is further configured to:

close the second valve at least in response to a determination that a determined pressure of the flash tank is below a threshold; and open the second valve at least in response to a determination that a determined pressure of the flash tank exceeds the threshold.

4. The system of claim 1, further comprising a heat exchanger configured to transfer heat from the flow of refrigerant from the second compressor to the flow of refrigerant from the second low side heat exchanger when the second valve is closed.

5. The system of claim 1, further comprising a fourth valve configured to prevent the flow of refrigerant from the second low side heat exchanger from flowing to the fourth compressor when the first valve is open.

6. The system of claim 1, further comprising a fourth valve configured to:

close when the first valve is open to prevent the refrigerant from the flash tank from flowing, as a flash gas, to the third compressor; and open when the first valve is closed to direct the refrigerant from the flash tank to the third compressor.

7. A method comprising:

storing, by a flash tank, a refrigerant;

using, by a first low side heat exchanger, the refrigerant from the flash tank to cool a space proximate the first low side heat exchanger;

using, by a second low side heat exchanger, the refrigerant from the flash tank to cool a space proximate the second low side heat exchanger;

compressing, by a first compressor, a flow of refrigerant from the first low side heat exchanger;

compressing, by a second compressor, a flow of refrigerant from the first low side heat exchanger;

compressing, by a third compressor, a flow of refrigerant from the second low side heat exchanger and a flow of refrigerant from the first compressor;

controlling, by a first valve, a flow of refrigerant from the flash tank to a fourth compressor;

controlling, by a second valve, a flow of refrigerant from the second compressor;

preventing, by a third valve disposed between the first valve and the second valve, a flow of refrigerant from the flash tank from flowing to the second compressor;

during a first mode of operation:

causing, by a hardware processor, the first valve to open such that the refrigerant from the flash tank flows, as a flash gas, through the first valve to the fourth compressor; and causing, by the hardware processor, the second valve to close such that the flow of refrigerant from the second compressor flows to the fourth compressor through the third valve; and during a second mode of operation, causing, by the processor, the first valve to close such that a flow of refrigerant from the second low side heat exchanger flows to the fourth compressor.

8. The method of claim 7, further comprising:

transitioning, by the processor, from the first mode of operation to the second mode of operation at least in response to a determination that a detected temperature exceeds a threshold; and transitioning, by the processor, from the second mode of operation to the first mode of operation at least in response to a determination that a detected pressure of the flash tank is below the threshold.

9. The method of claim 7, further comprising:

closing the second valve at least in response to a determination that a determined pressure of the flash tank is below a threshold; and opening the second valve at least in response to a determination that a determined pressure of the flash tank exceeds the threshold.

10. The method of claim 7, further comprising transferring, by a heat exchanger, heat from the flow of refrigerant from the second compressor to the flow of refrigerant from the second low side heat exchanger when the second valve is closed.

11. The method of claim 7, further comprising preventing, by a fourth valve, the flow of refrigerant from the second low side heat exchanger from flowing to the fourth compressor when the first valve is open.

12. The method of claim 7, further comprising:

closing a fourth valve when the first valve is open to prevent the refrigerant from the flash tank from flowing, as a flash gas, to the third compressor; and opening the fourth valve when the first valve is closed to direct the refrigerant from the flash tank to the third compressor.

13. A system comprising:

a flash tank configured to store refrigerant from a high side heat exchanger;

a first low side heat exchanger configured to use the refrigerant from the flash tank to cool a space proximate the first low side heat exchanger;

a second low side heat exchanger configured to use the refrigerant from the flash tank to cool a space proximate the second low side heat exchanger;

a first compressor configured to compress a flow of refrigerant from the first low side heat exchanger;

a second compressor;

a first valve configured to control a flow of refrigerant from the flash tank to the second compressor;

a second valve configured to control a flow of refrigerant from the first compressor;

a third valve disposed between the first valve and the second valve, configured to prevent a flow of refrigerant from the flash tank from flowing to the first compressor; and a controller comprising a memory and a hardware processor, the processor configured to:

during a first mode of operation, cause the first valve to open such that the refrigerant from the flash tank flows, as a flash gas, through the first valve to the second compressor; and cause the second valve to close such that the flow of refrigerant from the first compressor flows to the second compressor through the third valve; and during a second mode of operation, cause the first valve to close such that a flow of refrigerant from the second low side heat exchanger flows to the second compressor.

14. The system of claim 13, the processor is further configured to:

transition from the first mode of operation to the second mode of operation at least in response to a determination that a detected temperature exceeds a threshold; and transition from the second mode of operation to the first mode of operation at least in response to a determination that a detected pressure of the flash tank is below the threshold.

15. The system of claim 13, the processor is further configured to:

close the second valve at least in response to a determination that a determined pressure of the flash tank is below a threshold; and open the second valve at least in response to a determination that a determined pressure of the flash tank exceeds the threshold.

16. The system of claim 13, further comprising a heat exchanger configured to transfer heat from the flow of refrigerant from the first compressor to the flow of refrigerant from the second low side heat exchanger when the second valve is closed.

17. The system of claim 13, further comprising a fourth valve configured to prevent the flow of refrigerant from the second low side heat exchanger from flowing to the second compressor when the first valve is open.

* * * * *